United States Patent [19]

Yagii et al.

[11] 4,162,948

[45] Jul. 31, 1979

[54] METHOD OF DEHALOGENATING HALOGENATED HYDROCARBON TO YIELD ELEMENTAL HALOGEN

[75] Inventors: Kiyoshi Yagii, Kamifukuoka; Hideki Oshio, Kawagoe, both of Japan

[73] Assignee: Central Glass Company, Limited, Ube, Japan

[21] Appl. No.: 895,962

[22] Filed: Apr. 13, 1978

[30] Foreign Application Priority Data

Apr. 26, 1977 [JP] Japan ..... 52/47385

[51] Int. Cl.[2] ..... C25B 3/02

[52] U.S. Cl. ..... 204/80; 204/72; 204/79; 204/81

[58] Field of Search ..... 204/72, 80, 81, 78, 204/79

[56] References Cited

FOREIGN PATENT DOCUMENTS

| | | | |
|---|---|---|---|
| 2657148 | 6/1977 | Fed. Rep. of Germany | 204/81 |
| 186398 | 10/1966 | U.S.S.R. | 204/72 |
| 520342 | 8/1976 | U.S.S.R. | 204/72 |

*Primary Examiner*—F. C. Edmundson
*Attorney, Agent, or Firm*—Fleit & Jacobson

[57] ABSTRACT

A halogenated hydrocarbon such as a halogenated ethane or propane is dehalogenated by subjecting to electrolysis an aqueous reaction system containing the halogenated hydrocarbon, a halide of metal having dehalogenating ability and a detergent. The detached halogen leaves the reaction system in elemental form.

10 Claims, No Drawings

METHOD OF DEHALOGENATING HALOGENATED HYDROCARBON TO YIELD ELEMENTAL HALOGEN

BACKGROUND OF THE INVENTION

This invention relates to a method of dehalogenating a halogen-containing hydrocarbon such as a halogenated ethane or propane and recovering a resultant halogen in elemental form separate from the dehalogenated hydrocarbon.

Most of dehalogenation reactions for organic compounds involve hydrogenation, but dehalogenation of some organic halides can be achieved without accompaniment of hydrogenation by the use of a metal dehalogenating agent as exemplified by the following reactions.

$$CHCl_2CH_2Cl + Zn \xrightarrow{\text{water } 50°-60° \text{ C.}} CH_2{=}CHCl + ZnCl_2 \quad (1)$$

$$CHCl_2CH_2Cl + Fe \xrightarrow{\text{water } 100°-110° \text{ C.}} CH_2{=}CHCl + FeCl_2 \quad (2)$$

$$H_2C\begin{matrix}CH_2Br\\CH_2Br\end{matrix} + Zn \xrightarrow{\text{formamide } 20°-40° \text{ C.}} H_2C\begin{matrix}CH_2\\|\\CH_2\end{matrix} + ZnBr_2 \quad (3)$$

The reactions of Equations (1) and (2) are known as the most popular laboratory methods of preparing olefins and alkynes. These reactions are applicable to polyhalogenated alkanes such as 1,2-dichloroethane, 1,1,2,2-tetrachloroethane, pentachloroethane, hexachloroethane, 1,2-dibromoethane and 1,1,2-tribromoethane to obtain corresponding olefins. The reaction of Equation (3) is of use for preparing cycloparaffins in laboratories from 1,3-dichloropropane, 1,4-dichlorobutane, 1,4-dibromobutane, etc.

With respect to the dechlorination of 1,1,2-trichloro-1,2,2-trifluoroethane (Freon-113) to give chlorotrifluoroethylene by the use of zinc as represented by Equation (1), J. Am. Chem. Soc., Vol. 55, p. 2231 (1933) shows the use of alcohol as a dispersion medium, and U.S. Pat. No. 2,774,798 shows the use of an aqueous reaction system comprising a detergent together with zinc.

Also it is well known that, in certain cases, one molecule of a halogen can be separated from two molecules of a monohalogenated compound by the use of a metal dehalogenating agent: for example, biphenyl can be synthesized by debromination with copper powder of two molecules of bromobenzene.

The above described dehalogenation using a metal dehalogenating agent features a high selectivity of the product and in this regard is advantageous over other types of synthesis methods. However, this method is hardly appreciated as an industrially economical method because of the consumption of a dehalogenating agent in a quantity stoichiometrically corresponding to the quantity of the dehalogenated product. Besides, industrial application of this method is unfavorable from the viewpoint of preventing environmental pollution by reason of the formation of a noxious metal halide as an inevitable by-product.

As a different type of dehalogenation method for halogen-containing organic compounds, cathodic reduction of certain halogenated alkanes in formamide is reported in J. Org. Chem., Vol. 39, p. 3803 (1974) and Tetrahedron Lett. (1969), p. 1043. Presumably, this method will suffer from difficulty in separating the product from the reaction system and recovering the detached halogen.

SUMMARY OF THE INVENTION

It is an object of the present invention to provide an improved method of dehalogenating a halogenated hydrocarbon, which method is comparable to a conventional dehalogenation method utilizing a metal dehalogenating agent in selectivity of the product but does not form any metal halide as a by-product.

It is another object of the invention to provide a method of dehalogenating a halogenated hydrocarbon with liberation of the detached halogen in elemental form.

It is a still another object of the invention to provide a method of dehalogenating, particularly dechlorinating, a halogenated ethane or propane, which method can be economically put into industrial practice.

According to the invention, dehalogenation of a halogenated hydrocarbon is accomplished by subjecting to electrolysis a reaction system containing water, a compound to be dehalogenated, a halide of a metal having dehalogenating ability and a detergent.

As distinctive merits of this method, the detached halogen leaves the reaction system in elemental form and hence can be recovered easily, while the concentration of the metal halide in the reaction system remains unchanged.

A method of the invention is most suitable for application to dehalogenation of halogenated ethanes and propanes having at least two atoms of halogen which may be chlorine, fluorine and/or bromine. The electrolysis can be performed in a known manner. The use of a zinc halide as the metal halide is particularly preferable. The detergent can be chosen among known non-ionic, anionic and cationic detergents.

This method is based on the effectiveness of the use of a metal dehalogenating agent as represented by Equation (1) and a fact that electrolysis of a metal halide results in dissociation of the compound into the metal and halogen. For example, electrolysis of zinc chloride is represented by the following reactions.

$$\text{at cathode: } ZnCl_2 + 2e^- \rightarrow Zn + 2Cl^- \quad (4)$$

$$\text{at anode: } 2Cl^- \rightarrow Cl_2 + 2e^- \quad (5)$$

We have discovered that dehalogenation of a halogenated alkane in an aqueous phase proceeds smoothly with liberation of an elemental halogen when the reaction system contains a metal dehalogenating agent in the form of a halide together with a detergent and is subjected to electrolysis. Dechlorination of Freon-113 by a method of the invention is expressed by the following equation.

$$CF_2ClCFCl_2 \xrightarrow[\text{electrolysis}]{\text{water, } ZnCl_2\text{, detergent}} CF_2{=}CFCl + Cl_2 \quad (6)$$

This method is fundamentally different from the aforementioned electrolytic dehalogenation method in that the reaction is made to occur in an aqueous reaction system and that a principal object of flowing an electric current through the reaction system is not the utilization of solvated electrons at the cathode but the decomposition of the metal halide.

The invention can readily be put into industrial practice as a profitable dehalogenation method because of the following advantages of a method of the invention.

(1) The method features a high selectivity of the product since in principle the dehalogenation is achieved by means of a metal dehalogenating agent.

(2) It is possible to effectively utilize a material to be dehalogenated since the detached halogen can be recovered in elemental form.

(3) There is no need of recovering a noxious metal halide from the reaction system and disposing of it so as to prevent environmental pollution.

(4) The method can be performed in a continuous manner.

(5) A dehalogenation reaction can be completed within a single reaction vessel.

DESCRIPTION OF PREFERRED EMBODIMENTS

A method of the invention is most suitable for application to dehalogenation of halogenated alkanes having two or three carbon atoms and at least two halogen atoms which may be chlorine, fluorine and/or bromine. In practice, dechlorination will probably have the largest chance to be intended. Examples of halogenated alkanes which can readily be dehalogenated by a method of the invention are: 1,2-dichloroethane; 1,1,2-trichloroethane; 1,1,2,2-tetrachloroethane; 1,1,1,2-tetrachloroethane; pentachloroethane; hexachloroethane; 1,3-dichloropropane; 1,3-dibromopropane; pentachlorofluoroethane; tetrachloro-1,1-difluoroethane; tetrachloro-1,2-difluoroethane; 1,1,2-trichloro-1,2,2-trifluoroethane; 1,2-dichlorotetrafluoroethane; 1,1,2,2-tetrachloro-2-fluoroethane; 1,2,2-trichloro-1,1-difluoroethane and 1,2-dichloro-1,1-defluoroethane. In the present invention, a material to be dehalogenated may be a mixture of two or more of these halogenated compounds. It should be noted that the halogens to be removed are located on different carbon atoms.

A metal halide serving both as a dehalogenating agent and an electrolyte can be selected from various halides of metals known as dehalogenating agents such as zinc, iron and cadmium, but the use of a zinc halide, particularly zinc chloride, is the most preferable. Ferrous chloride and cadmium chloride are examples of other metal halides convenient for practical use.

A detergent for use in a method of the invention can be selected from commercially available non-ionic, anionic and cationic detergents. The selection is made such that the detergent does not react with the metal of the metal halide to form a water insoluble compound. Examples of suitable detergents are polyglycolether esters, alkylsulfuric esters and sodium dodecylbenzene sulfonate.

In an aqueous reaction system according to the invention, the amounts of the respective components can be varied over considerably wide ranges. The reaction system is made to contain a halogenated hydrocarbon to be dehalogenated in an amount sufficient for over-saturation in water. Usually the reaction system is made to contain about 0.05 to about 10 moles of the halogenated hydrocarbon (about 10 to about 2000 g when the halogenated hydrocarbon is Freon-113, for example) per 1000 g of water. The amount of the metal halide at the start of the reaction is preferably made to range from about 0.4 to about 15 moles (from about 50 to about 2000 g when zinc chloride is used) per 1000 g water. The amount of the detergent is preferably made to range from about 1 to about 50 g per 1000 g of water.

Optionally the reaction system may comprise either an acid such as hydrochloric acid, sulfuric acid or phosphoric acid or an alcohol such as methanol, ethanol or isopropyl alcohol in a small amount.

The electrolysis in a method of the invention can be performed by an ordinary technique using an ion exchange membrane, a resin membrane, an asbestos membrane or a ceramic membrane. The material of the anode plate may be carbon, platinum, ruthenium, palladium, iridium or gold, either in the form of plate or as a plated coating on a plate of a different metal. The material of the cathode plate may be nickel, copper, zinc, iron, titanium, chromium, cobalt, tin, cadmium, antimony, mercury, lead or silver, either in the form of plate or as a plated coating on a plate of a different metal.

The electrolysis is effected by the application of a voltage of about 2.7 to about 40 V to the electrodes, and the aqueous reaction system is maintained at temperatures between 0° and 100° C. and at pressures between 0 and 1 kg/cm$^2$ (gauge pressure) during dehalogenation reaction with continued electrolysis.

The following examples are presented to illustrate a dehalogenation process according to the invention.

EXAMPLE 1

This example relates to the dechlorination of $CF_2ClCFCl_2$ (Freon-113). A cylindrical glass vessel of 2 liters in capacity was used as a reaction vessel with the provision of water bath to maintain the vessel at a desired temperature. The interior of the vessel was partitioned with an ion exchange membrane (NAFION 701 of E. I. du Pont de Nemours & Co.) into a cathode chamber and an anode chamber. The cathode chamber was provided with an agitator and a reflux condenser and the anode chamber with a reflux condenser. Gaseous products passed through the reflux condensers were collected individually by the use of a −78° C. bath constituted of dry ice and methanol. It was preferable to use a zinc plate as the cathode plate for the intended electrolysis, but instead use was made of an aluminum plate measuring 10 cm by 9 cm in order to facilitate the evaluation of the experimental result. The anode plate was a platinum plate measuring 1 cm by 3 cm.

The cathode chamber of the reaction vessel thus rendered an electrolytic cell was charged with 348 g of Freon-113, 372 g of zinc chloride, 603 g of water and 3.5 g of an anionic detergent (sodium dodecylbenzene sulfonate in this case), and the reaction vessel was maintained at 40° C. while the reflux condensers for the cathode and anode chambers were both cooled to 5° C. With continuous stirring of the reaction system, a voltage of 10 to 15 V was applied to the cathode and anode plates from the start of the reaction so as to cause a constant current of 5 A to flow between the cathode and anode plates. The decomposition of Freon-113 proceeded slowly accompanied with gas generation in both the cathode and anode chambers, so that the quantities of condensates collected through the respective reflux condensers increased slowly as the time elapsed. After the lapse of 3 hr from the start of the experiment (commencement of the voltage application) analysis was made on the respective condensates collected during next 1 hr, with the result that the condensate of the gas produced in the cathode chamber was a mixture of 8.9 g of $CF_2{=}CFCl$ and 1.5 g of Freon-113 containing trace amount of impurities while the condensate originated from the anode chamber was 6.4 g of chlorine. The voltage application was continued further until the total reaction time amounted to 9 hr, and it was found that neither of the cathode and anode plates exhibited any change in weight through the 9 hr long reaction.

EXAMPLE 2

This example relates to the dechlorination of 1,1,2-trichloroethane. Using the apparatus of Example 1, the cathode chamber of the reaction vessel was charged with 336 g of 1,1,2-trichloroethane, 279 g of zinc chloride, 583 g of water and 3.0 g of sodium dodecylbenzene sulfonate. The reaction vessel was kept at 60° C., and the respective reflux condensers were cooled to 5° C. From the start to the end of the experiment a constant current of 5 A was made to flow between the cathode and anode plates by the application of a voltage of 10 to 14 V.

After the lapse of 3 hr from the start of the voltage application, analysis was made on the respective condensates of gases produced in the cathode and anode chambers and collected during next 1 hr. The result was that the condensate originated from the cathode chamber was 5.9 g of vinyl chloride containing trace amounts of impurities while the condensate from the anode chamber was 6.3 g of chlorine. The reaction was made to continue for 5 hr in total, but the cathode and anode plates showed no change in weight.

What is claimed is:

1. A method of dehalogenating a halogenated hydrocarbon with liberation of the detached halogen in elemental form, the method comprising the step of subjecting to electrolysis a reaction system containing water, a halogenated hydrocarbon to be dehalogenated, said halogenated hydrocarbon in said reaction system is a halogenated alkane having at least two but not more than three carbon atoms and at least two atoms of at least one halogen selected from the group consisting of fluorine, chlorine and bromine; with the proviso that the halogens to be removed are on different carbon atoms, zinc chloride and a detergent.

2. A method according to claim 1, wherein said detergent is selected from the group consisting of polyglycolether esters, alkylsulfuric esters and sodium dodecylbenzene sulfonate.

3. A method according to claim 2, wherein said reaction system contains initially about 0.05 to about 10 moles of said halogenated hydrocarbon and about 0.4 to about 15 moles of said zinc chloride per 1000 g of water.

4. A method according to claim 3, wherein said reaction system contains about 1 to about 50 g of said detergent per 1000 g of water.

5. A method according to claim 2, wherein said reaction system comprises an acid.

6. A method according to claim 2, wherein said reaction system comprises an alcohol.

7. A method according to claim 1, wherein said reaction system is maintained at temperatures between 0° to 100° C. during electrolysis.

8. A method according to claim 7, wherein said reaction system is maintained at pressures between 0 and 1 $kg/cm^2$ by gauge pressure during electrolysis.

9. A method of dechlorinating halogenated alkanes having two or three carbon atoms and at least two chlorine atoms with the two chlorine atoms on different carbon atoms with liberation of the detached chlorine in elemental form, the method comprising the step of subjecting to electrolysis a reaction system containing water, at least one of said halogenated alkanes, zinc chloride and a detergent.

10. A method according to claim 9, wherein at least one of said halogenated alkanes in said reaction system has at least one atom of a halogen selected from the group consisting of fluorine and bromine.

* * * * *